US005234147A

United States Patent [19]

Greenwalt

[11] Patent Number: 5,234,147

[45] Date of Patent: Aug. 10, 1993

[54] SETTING MACHINE HAVING MOVEABLE UPPER RECEIVER

[75] Inventor: Howard Greenwalt, Gainesville, Ga.

[73] Assignee: Scovill Fasteners Inc., Clarkesville, Ga.

[21] Appl. No.: 930,278

[22] Filed: Aug. 17, 1992

[51] Int. Cl.[5] ..... A41H 37/04

[52] U.S. Cl. ..... 227/149; 227/30

[58] Field of Search ..... 227/149, 30, 140; 29/243.53

[56] References Cited

U.S. PATENT DOCUMENTS 688,026 12/1901 Marks ..... 227/149

4,454,650 6/1984 Silver ..... 227/149 X 4,615,473 10/1986 Taga ..... 227/149 X 4,775,090 10/1988 Kuo ..... 227/149

*Primary Examiner*—Frank T. Yost

*Assistant Examiner*—Raymond D. Woods

*Attorney, Agent, or Firm*—Dallett Hoopes

[57] ABSTRACT

A vertically moveable upper receiver is suspended on the machine by spring means and has a central vertical cavity therethrough. A pair of opposed springs bias together jaws in the receiver having aligned notches therein which receive the part. The upper tool or punch descends through the cavity, engages the part, drives it out of its notches and downward against the inward pressure of the jaws, the receiver descending through this operation, and the part arrives precisely centered at the setting locus.

3 Claims, 2 Drawing Sheets

SETTING MACHINE HAVING MOVEABLE UPPER RECEIVER

BACKGROUND OF THE INVENTION

1. Field of the Invention

This invention relates to fastener setting machines. More specifically, the invention relates to a fastener setting machine in which the upper receiver for the fastener part comprises spreadable jaws pivotally mounted in an assembly which descends toward the setting locus as the punch comes down. For safety reasons, the upper position of the receiver is closely spaced above the guide plate.

2. Description of Related Art

The prior art includes a number of receivers for setting machines. An example is shown in the U.S. Pat. No. 1,632,374 to A. F. Havener. In this patent fixed jaws hold the part until the upper punch comes down driving the jaws open and forcing the part downward to the setting locus.

In another U.S. Pat. No. 434,214 which issued Aug. 12, 1890 to J. L. Thompson rivet-holding shoulders are in a moveable receiver. A punch comes down forcing the shoulders to give way taking the part with it.

Spencer U.S. Pat. No. 277,369 shows a rivet setting machine in which the jaws stay at a fixed level and serve as a receiver for the upper part. The punch comes down, engages the part and forces it to open the jaws, driving the part on down to the setting locus.

In all of the above receiver arrangements there is a definite safety hazard in that the distance between the level of the jaws and the setting locus is considerable and it is possible for the operator to have the punch descend before he can withdraw his fingers.

More recently the emphasis has been on safety. A typical arrangement is as shown in the U.S. Pat. No. 4,343,423 to O. S. Sauermilch which issued Aug. 10, 1982 and in which the guard descends before the punch. If the guard is blocked from fully descending because the operator's fingers are in the way, the stroke of the punch itself is blocked until the obstacle is removed.

A more recent reference is U.S. Pat. No. 4,454,650 to B. R. Silver. The upper tool receiver is installed in an oversize head which is stationarily mounted on the setting machine so that its lower end is closely adjacent the setting site. The head includes jaws which temporarily receive the fastener part. A punch then comes down through the jaws grabbing the part and holding it with special retaining means, then continuing its travel to the setting site. In Silver the intention is that an operator will not be able to get his fingers between the bottom of the oversize head and the setting site.

The Silver patent has required that the punch have retaining means to hold the fastener part on its brief and precipitous downward travel. Such retaining means have not always been reliable. In addition, because the head is stationarily mounted on the setting machine, the lower receiver is not readily accessible.

SUMMARY OF THE INVENTION

The present invention provides a movable upper receiver which, though its travel is short, assures the precise directing of the part toward the setting site. This is achieved by the friction of the descending part being pushed by the punch against the opening jaws of the punch which provide uniform inward pressure to retain the part against the punch as the punch comes down.

The invention, then, is a vertically moveable upper receiver suspended on the machine by spring means and having a central vertical cavity therethrough. A pair of opposed springs bias together jaws having aligned notches therein which receive the part. The punch descends through the cavity, engages the part, forces it out of its notches and downward against the inward pressure of the jaws, the receiver descending during this operation and the part arrives precisely centered at the setting locus.

BRIEF DESCRIPTION OF THE DRAWINGS

Further objects and features of the invention will be apparent to those skilled in the art from the following specification and the drawings, all of which disclose a non-limiting embodiment of the invention. In the drawings.

DESCRIPTION OF THE PREFERRED EMBODIMENT

Figure 1:
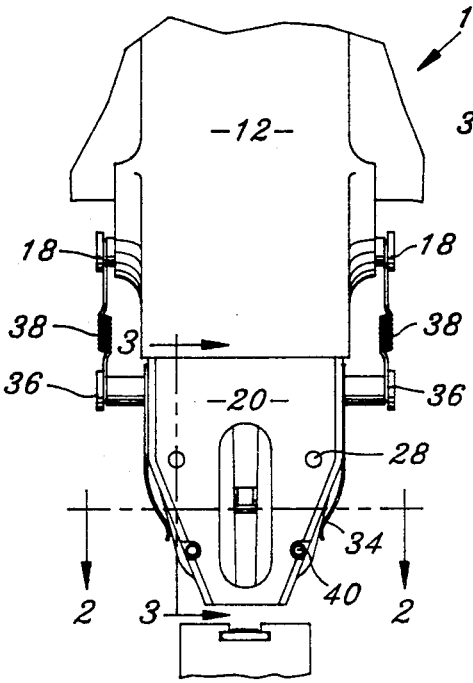
FIG. 1 is a fragmentary front view of a receiver embodying the invention installed on a setting machine.
Figure 4:
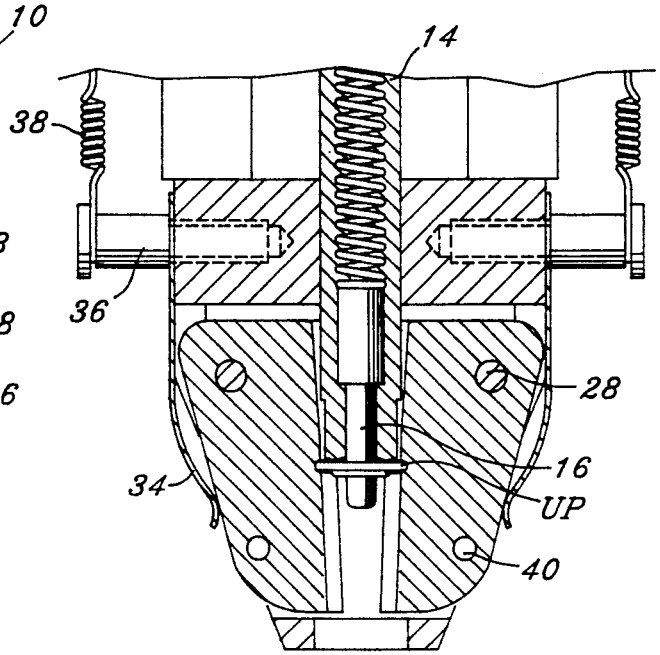
FIG. 4 is an enlarged sectional view taken on the line 4—4 of FIG. 2 and showing the receiver in rest position and including a fragmentary view of the punch and the receiver suspension means.

FIG. 1 shows a setting machine equipped with the moveable receiver of the invention and generally designated 10. The setting machine may be a model 150 made by Scovill Fasteners Inc., for instance. The forward housing 12 of the machine contains an upper tool or punch 14 which may be hollow and containing a spring-biased reciprocal pin 16 which normally extends out from the lower end of the punch. On either side of the housing 12 respectively are a pair of supporting ears 18.

Figure 5:
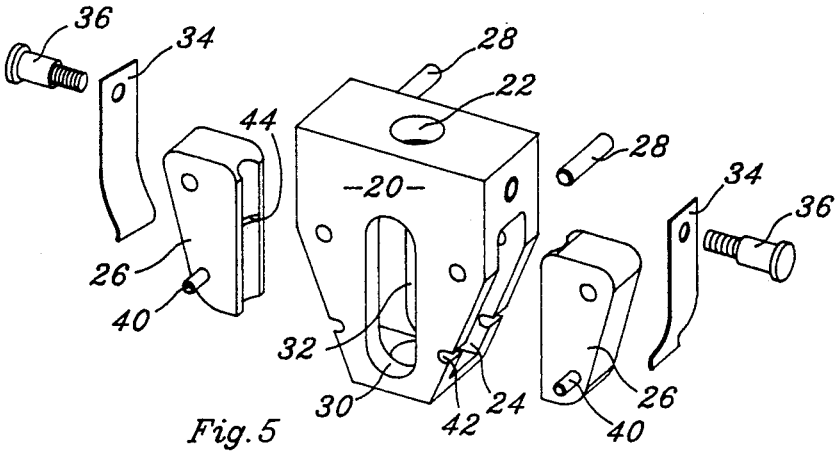
FIG. 5 is an exploded view of a receiver and its components.

Disposed about the lower end of the punch 14 is the upper receiver 20 which comprises a generally rectangular body having inwardly tapered sides at its lower end. The body has a central vertical cavity 22 (FIG. 5) and is slotted at its sides as at 24 to receive jaws 26. The body and jaws are apertured to receive pins 28 which pivot the jaws at their upper end to swing in the cavities 24. The front and rear of the body of the receiver 20 are apertured with windows 30 and 32.

Leaf springs 34 are provided and are secured against the upper side faces of the body of the receiver by threaded and headed dowels 36. The lower ends of the springs 34 bear inward against the lower end of the jaws 26. Spiral springs 38 connect between the ears 18 and the dowels 36 to suspend the receiver. Preferably, the springs 38 and the axis of the punch 14 are all in the same plane. Stop pins 40 fit in notches 42 to stop the inward drive of the lower end of the jaws.

Figure 2:
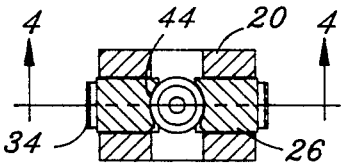
FIG. 2 is a sectional view taken on the line 2—2 of FIG. 1.
Figure 3:
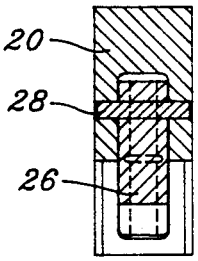
FIG. 3 is a sectional view taken on the line 3—3 of FIG. 1.

As shown in FIG. 2, the near faces of the jaws ar formed concavely and are annularly notched at 44 to receive the upper fastener part UP. When the receiver 20 has its upper end butting against the undersurface of the housing 12 as it is between strokes of the punch, the level of the upper part feeder or pusher (not shown).

Figure 6:
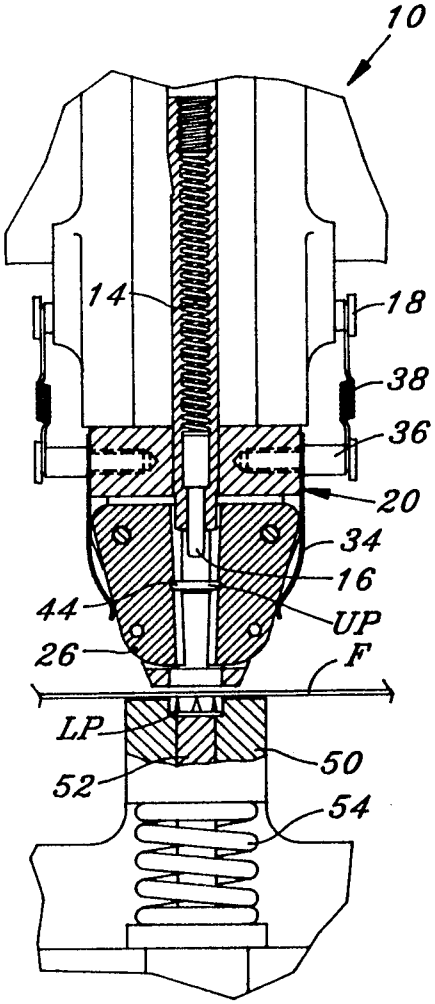
FIG. 6 is similar to FIG. 4 but includes more of the setting machine including the lower receiver and fabric F and showing the punch in its upper position.

Referring now to FIG. 6, the setting machine 10 also comprises a lower receiver 50 having a central opening receiving a stationary anvil 52. The lower part LP is received from the lower pusher, or feeder (not shown). The receiver 50 is biased upward tot he position shown by spring 54, and during the setting operation (FIG. 9) the upper receiver depresses the outer portion of the lower receiver 50.

FIGS. 6 through 9 show progressively the movement of the punch, jaws and part UP down toward the setting site.

In FIG. 6 the upper part UP has been received into its annular groove 44 from the feeder mechanism (not shown). The punch 14, shown in section, has started on its descent.

Figure 7:
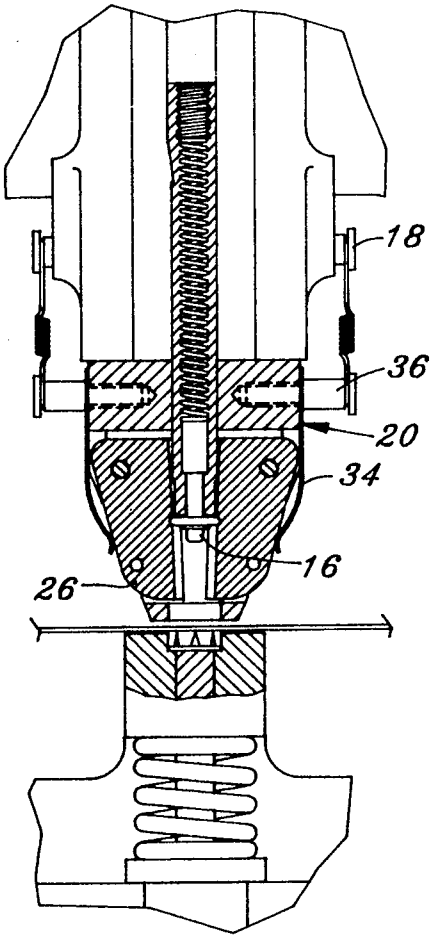
FIG. 7 progresses from FIG. 6; and shows the punch engaging the fastener part in the receiver.

In FIG. 7 the punch has reached the upper part UP and the pin 16 has been received into the opening in the part.

Figure 8:
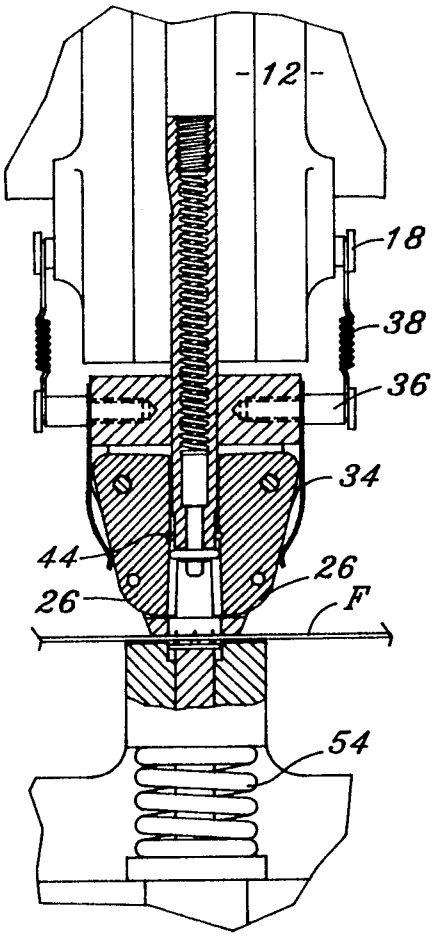
FIG. 8 is similar to FIGS. 6 and 7 but shows the punch having driven the part out of its retaining grooves and the receiver partially lowered.

In FIG. 8 the punch has driven the part UP downward out of its annular groove 44 and the part is engaged directly by the concave surfaces of the jaws because the punch adjacent its lower end is narrower in diameter than the flange of the fastener part. The part is thus frictionally held between the concave faces of the jaws 26. The jaws exert uniform pressure being biased by the springs 34 serving to squeeze the part, resisting its downward movement to maintain the part UP flat against the lower face of the descending punch. The resistance offered by the spring bias of the jaws toward the part results in a downward force on the receiver so that the receiver itself, as shown in FIG. 8 suspended by springs 38, moves downward toward the fabric F which rests on the guide plate (not shown).

Figure 9:
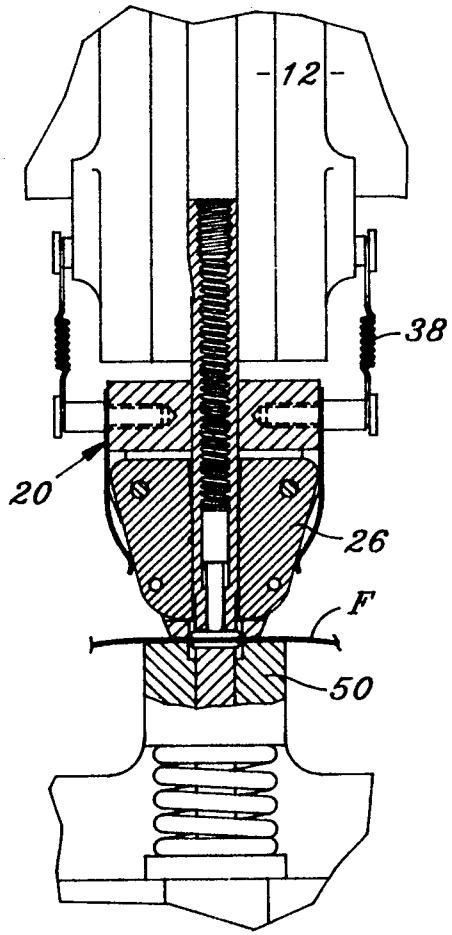
FIG. 9 is similar to FIG. 8 but showing the receiver in its most downward position and the punch forcing the fastener part into attachment with the lower part, the lower end of the upper receiver pushing through the fabric to lower the lower receiver.

FIG. 9, as shown by the gap between the upper surface of the receiver 20 and the lower surface of the housing 12, depicts the receiver 20 in its lowermost position. By traveling down with the descending part UP and the punch, the receiver has itself participated in the precise location of the part UP on the setting site. The lower nose of the upper receiver 20 depresses the fabric and actually urges the outer ring of the lower receiver downward so that the fastener part, sitting up on its anvil 52, is available fully for the setting operation.

Because the setting is now complete, the upward movement of the punch and the upward urging of the springs 38 draw the upper receiver 20 towards its home position against the underside of the housing 12.

The precise travel of fastener part UP assured by the downward movement of the upper receiver is made even more attractive by the fact that the travel of the upper receiver is not great. Preferably at its uppermost level the upper receiver will not provide sufficient room to permit the operator to insert his fingers between the upper and lower receivers. At the same time, because the upper receiver is moveable, the lower receiver is more available for attention and work than if the receiver moved not at all.

There are, thus, considerable benefits in the use of the invention as embodied in the structure shown. Variations of the invention are, of course, possible. Hence, the invention is not limited to the embodiment shown but the invention is instead defined by the scope of the following claim language, expanded by an extension of the right to exclude as is appropriate under the doctrine of equivalents.

What is claimed is:

1. In combination:

a. an upper fastener part having a periphery of a certain diameter, and b. a machine for assembling and attaching fastener parts to a fabric, the machine having a frame, upper and lower fastener tools operative in the frame, the lower tool having an upper end, and a guide plate on the frame for supporting said fabric adjacent the upper end of said lower tool, said upper tool including means for reciprocating vertically to effect assembly of said upper fastener part and a lower fastener part with said fabric therebetween, a vertically moveable upper receiver suspended on the machine frame by spring means about said upper tool, the receiver comprising a body having a central axial cavity therethrough, a pair of opposed spring-biased-together jaws having upper and lower ends and being pivoted at the upper ends of the jaws in the receiver, the jaws having concave surfaces along inward vertical faces and aligned horizontal concave receiving grooves in the respective vertical faces, the grooves serving as a pocket to hold said upper fastener part by said periphery, the upper tool having a lower end with a diameter less than the certain diameter of the periphery whereby the means for reciprocating causes the upper tool to descend through the axial cavity and engage the upper fastener part and drive the upper fastener part out of the pocket, the upper fastener part then being squeezed between the concave surfaces below the pocket to retard downward travel of the upper fastener part and keep the upper fastener part engaged against the lower end of the upper tool as the upper tool drives down, the driving down of the upper tool and the engagement of the upper tool with the upper fastener part lowering the receiver to adjacent the fabric and finally the upper tool drives the upper fastener part down out of the jaws into engagement with the lower fastener part to set the upper and lower fastener parts together.

2. A combination as claimed in claim 1 wherein the lower ends of the respective jaws carry lateral pins contacting the receiver to serve as stops for inward travel of the jaws.

3. A combination as claimed in claim 1 wherein the spring means comprises a pair of coil springs on opposite sides respectively of the upper tool and coplanar with the upper tool, an upper end of each spring being attached to the machine frame and a lower end of each spring being attached to the upper receiver.

* * * * *